United States Patent [19]

Woolfolk

[11] Patent Number: 4,811,008

[45] Date of Patent: Mar. 7, 1989

[54] COLOR PIGMENT GRAPHICS INFORMATION DISPLAY

[76] Inventor: Robert L. Woolfolk, 7127 Churchill Way, Dallas, Tex. 75230

[21] Appl. No.: 56,057

[22] Filed: Jun. 1, 1987

Related U.S. Application Data

[63] Continuation-in-part of Ser. No. 924,751, Oct. 30, 1986, Pat. No. 4,769,638.

[51] Int. Cl.[4] ..... G09G 3/16

[52] U.S. Cl. ..... 340/763; 340/764; 340/815.1; 340/815.26; 40/449

[58] Field of Search ..... 340/763, 764, 783, 803, 340/815.04, 815.03, 815.08, 815.1, 815.14, 815.29, 788, 815.26, 815.27, 815.32; 40/463, 466, 484, 449; 350/4.2, 109

[56] References Cited

U.S. PATENT DOCUMENTS

| | | | |
|---|---|---|---|
| 3,140,553 | 7/1964 | Taylor | 40/426 |
| 3,186,115 | 6/1965 | Todt et al. | 40/449 |
| 3,199,098 | 8/1965 | Schwartz | 340/764 |
| 3,304,549 | 2/1967 | Aiken . | |
| 3,365,824 | 1/1968 | Winrow . | |
| 3,447,150 | 5/1969 | Aiken . | |
| 3,624,941 | 12/1971 | Chantry . | |
| 3,764,200 | 10/1973 | Glattli . | |
| 3,772,686 | 11/1973 | Chardon . | |
| 3,936,816 | 2/1982 | Murata | 340/763 |
| 3,963,326 | 6/1976 | Buchert . | |
| 3,996,680 | 12/1976 | Smith . | |
| 4,015,255 | 3/1977 | Wood . | |
| 4,069,480 | 1/1978 | Helwig . | |
| 4,092,637 | 5/1978 | Barclay et al. . | |
| 4,115,941 | 9/1978 | Stephenson | 340/763 |
| 4,117,478 | 9/1978 | Skrobisch . | |
| 4,129,861 | 12/1978 | Giglio . | |
| 4,150,362 | 4/1979 | Uede et al. . | |
| 4,187,632 | 2/1980 | Rydstrom . | |
| 4,201,984 | 5/1980 | Inami et al. . | |
| 4,223,464 | 9/1980 | Winrow . | |
| 4,248,501 | 2/1981 | Simpson . | |
| 4,263,736 | 4/1981 | Beirwaltes et al. . | |
| 4,264,906 | 4/1981 | Wakatake | 340/764 |
| 4,268,821 | 5/1981 | DeSmet . | |
| 4,318,098 | 3/1982 | McGreevy | 340/764 |
| 4,328,492 | 3/1982 | Bobak et al. | 340/764 |
| 4,344,070 | 8/1982 | Forest et al. . | |
| 4,380,879 | 4/1983 | Seibert | 340/815.04 |

*Primary Examiner*—Gerald L. Brigance
*Assistant Examiner*—Mahmoud Fatahi-Yar
*Attorney, Agent, or Firm*—Warren H. Kintzinger

[57] ABSTRACT

Graphics information display panels made up of basic picture elements running to hundreds, or more, are useful for being viewed for advertising, transportation information, traffic control, news, weather, financial data and other information normally generated by computers. The system has capability in alphanumeric and also for color graphics designs in four colors through use of a basic display element with a transparent cylinder having four different color pigment enclosing compartments (or cavities) rotatable about a center rod mounting thereof. A six cavity transparent cylinder provides for design displays in six colors. Color pigments, either liquid or powder, are used to fill pixel cylinder cavities as fade resistant color medias where exposure to sunlight or ultraviolet radiation otherwise tends to cause deterioration of color pigment. A selective percentage mix of glass beads with pigment powder or liquid aids in mix stirring the pigment with movement of the pixel and a degree of backlight transparency to the pigment mix. The four-color drum uses a two coil and circular pixel magnet drive for controlled positioning with the electromagnetic coils at right angles, and with the six-color drum three electromagnetic coils positioned sixty degrees apart. Color field of view expanding devices overlie space between pixels. A spherical six color cavity pixel structure is also presented that is positioned by three electromagnetic coils working with two permanent bar magnets at right angles to each other in each spherical pixel.

19 Claims, 4 Drawing Sheets

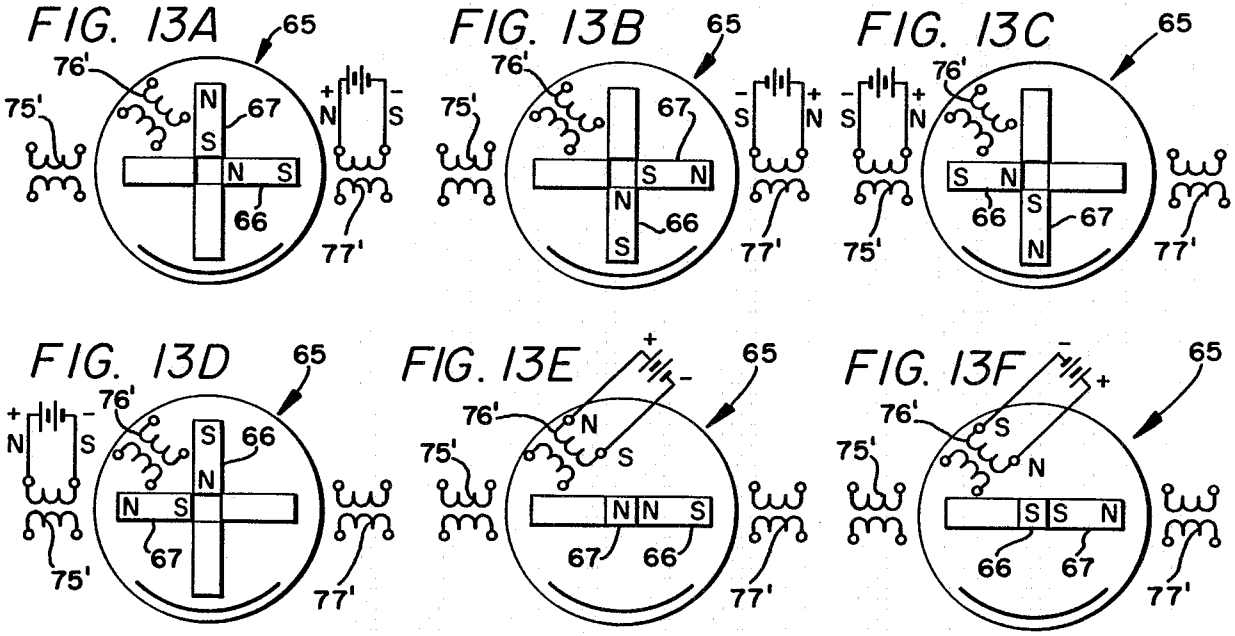
FIG. 13A
FIG. 13B
FIG. 13C
FIG. 13D
FIG. 13E
FIG. 13F
65
66
67
75'
76'
77'
N
S
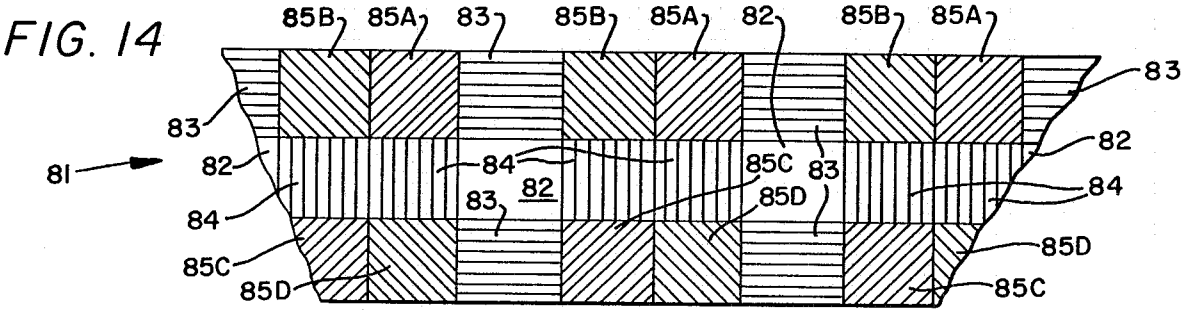
FIG. 14
81
82
83
84
85A
85B
85C
85D

COLOR PIGMENT GRAPHICS INFORMATION DISPLAY

This is a continuation-in-part application of my copending application, Ser. No. 06/924,754, filed Oct. 30, 1986, now U.S. Pat. No. 4,769,638.

SUMMARY OF THE INVENTION

This invention relates in general to color graphics information display systems, and more particularly, to information display panels made up of basic multi-color pixels running to hundreds and even more each having a plurality of color pigment, either liquid or powder, filled cavities, with the pixels rotatably mounted and electromagnetically positionable to desired color settings.

Large scale color graphic displays are useful for in-store advertising, outdoor billboard use, traffic control, shopping malls, airports, sports arenas and for many other uses. Pre-existing technology has made extensive use of incandescent lamps and two-sided flip over disks. It is important that large scale color graphic displays have good readability in high or low ambient light conditions. Multiple foreground and background colors are desired for example six colors including black and white with color change control as needed. Some of the previous display systems impose excessive power requirements making them costly to operate whereas minimum power consumption even zero power except during change cycles is desired. It is important that multiple element displays be made up using simple, inexpensive and easily replaceable color elements that are resistive to effects from weather in the outdoor environment. Such displays should be effective through a wide viewing angle and useful in fully modular display panels that are quickly removeable and that provide flexibility in overall size and aspect ratio. Computer control drive is helpful in providing reasonably fast response color element position setting times.

It is therefore a principal object of this invention to provide an improved color graphics information display that is highly visible in varying degrees of ambient lighting.

Another object is to provide such a graphics display that is cost effective, and easy to service and maintain.

A further object is to provide such a graphics display that imposes minimal power requirements.

Still another object is to provide such a graphics display with multiple foreground and background colors quickly changeable as desired.

Another object is to provide such a display made up of many multicolor display elements each subject to being color position changed by electronic magnetic circuit controls.

A further object is to control such display by computer controls for dramatically effective dynamically changeable displays.

Features of the invention useful in accomplishing the above objects include, in a color pigment graphics information display, basic picture elements running to hundreds, or more, are useful for being viewed for advertising, transportation information, traffic control, news, weather, financial data and other information normally generated by computers. The system has capability in alphanumeric and also for color graphics designs in four colors through use of a basic display element with a transparent cylinder having four different color pigment enclosing compartments (or cavities) rotatable about a center rod mounting thereof. A six cavity transparent cylinder provides for design displays in six colors. Color pigments, either liquid or powder, are used to fill pixel cylinder cavities as fade resistant color medias where exposure to sunlight or ultrviolet radiation otherwise tends to cause deterioration of color pigment. A selective percentage mix of glass beads with pigment powder or liquid aids in mix stirring the pigment with movement of the pixel and a degree of backlight transparency to the pigment mix. The four-color drum uses a two coil and circular pixel magnet drive for controlled positioning with the electromagnetic coils at right angles, and with the six-color drum three electromagnetic coils positioned sixty degrees apart. Color field of view expanding devices overlie space between pixels, A spherical six color cavity pixel structure is also presented that is positioned by three electromagnetic coils working with two permanent bar magnets at right angles to each other in each spherical pixel. A square thin sheet of ferritic material with truncated cut off corners is provided on one end of each cylindrical pixel for positive indexing of the pixel cylinder at each of it's four settings with the "pull" from a small permanent magnet subject to being overcome by the main electromagnetic force of a col being energized for color resetting. With a six color cylindrical pixel a six sided thin sheet of ferritic material is used having truncated corners for positive index stopping the pixel at a desired color setting with pull from a small permanent magnet for that pixel.

Specific embodiments representating what are presently regarded as the best modes of carrying out the invention are illustrated in the accompanying drawings.

BRIEF DESCRIPTION OF THE DRAWING

FIGS. 13A-13F, position operational sequence for a six segment-color spherical display of element of FIGS. 9-12; and FIG. 14, a partial view of a Fresnel image expander panel and front cover used over rows of the six color double sphere enclosed display elements of FIGS. 9-13F.

DESCRIPTION OF THE PREFERRED EMBODIMENTS

Figure 5:
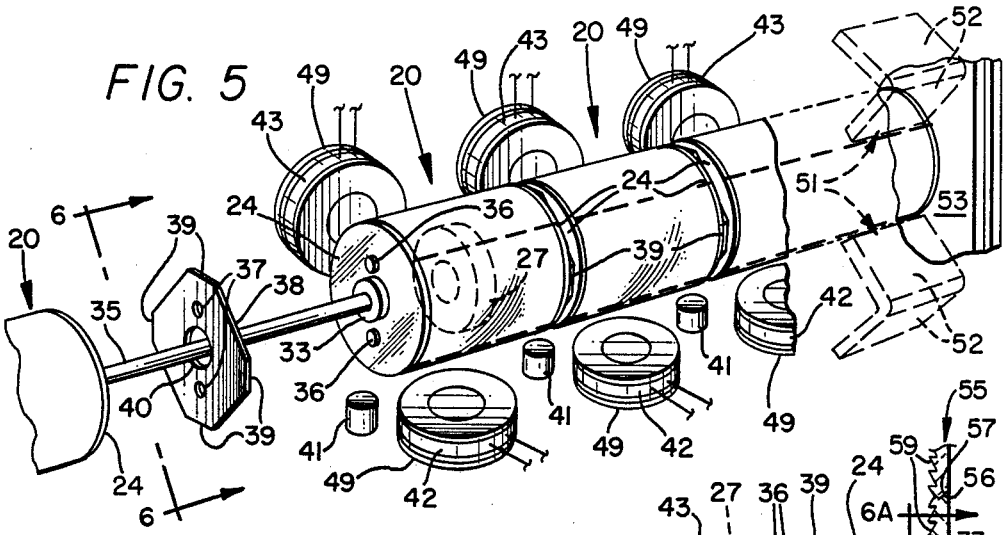
FIG. 5, a perspective view partially exploded of a row of rotatably mounted four cavity pixels along with electromagnet positioning coils therefore.
Figure 6:
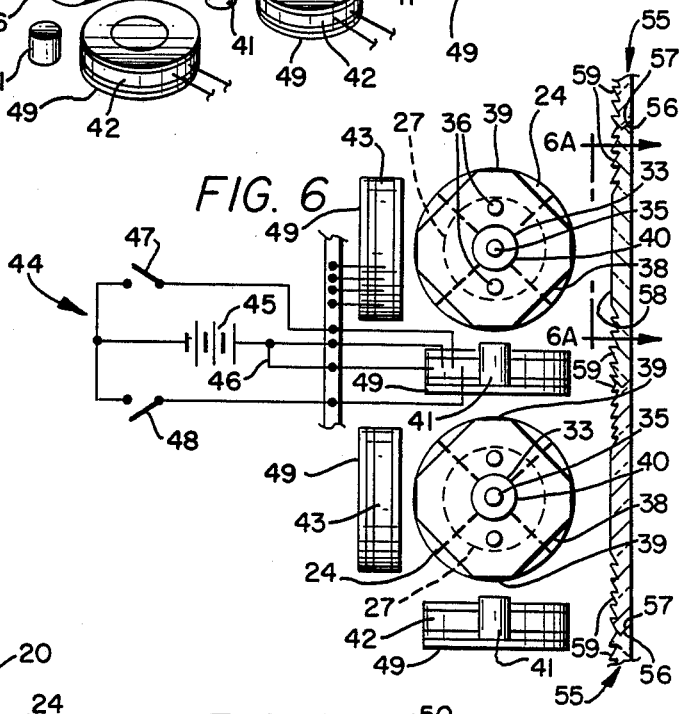
FIG. 6, a partial cut-away and sectioned side elevation view along line 6—6 of FIG. 5 through two rotatably mounted pixel rows of four cavity four color pixels the positioning electromagnetic coils therefore and control circuitry schematic detailing, and color field of view enlarging combination optic and front cover detail.
Figure 7:
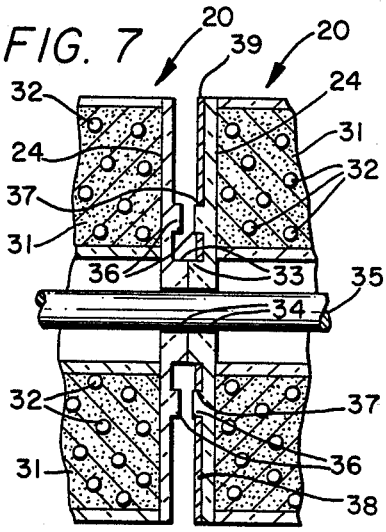
FIG. 7, an enlarged cut-away and sectioned partial view showing the end to end relationship of two pixels on their common rotatable mounting on a rod.
Figure 8:
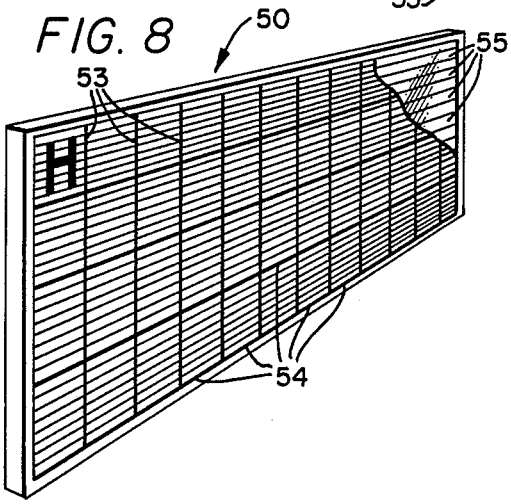
FIG. 8, a perspective view of a multi-element color graphics information display panel that uses the pixels.
Figure 9:
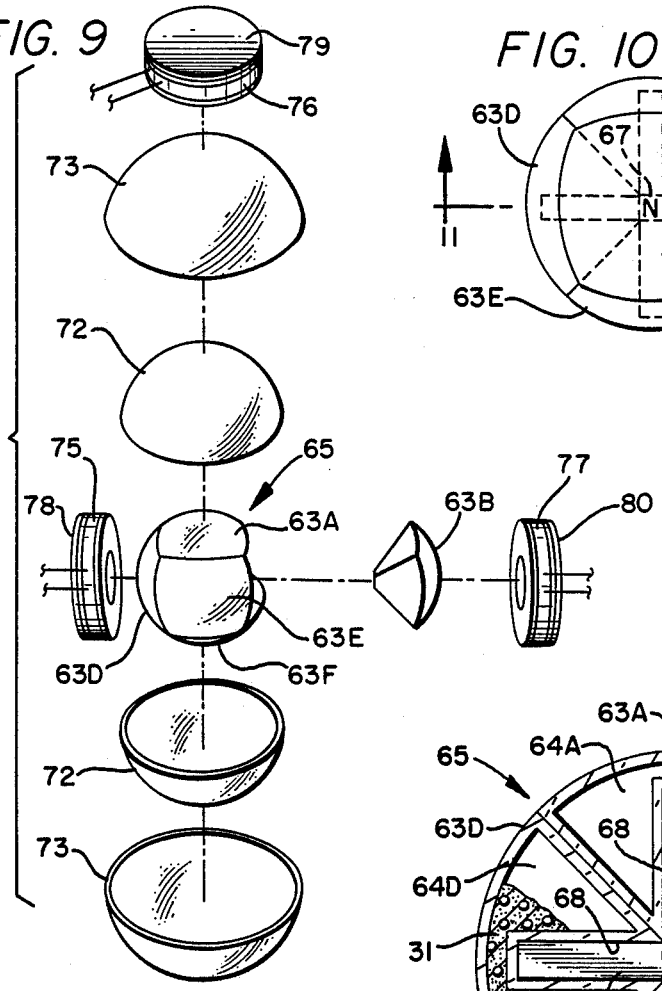
FIG. 9, an exploded perspective view of a six color double sphere enclosed display element.
Figure 10:
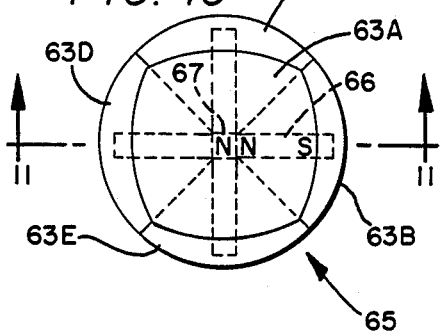
FIG. 10, an enlarged view of the six color six segmented inner spherical display element of FIG. 9.
Figure 11:
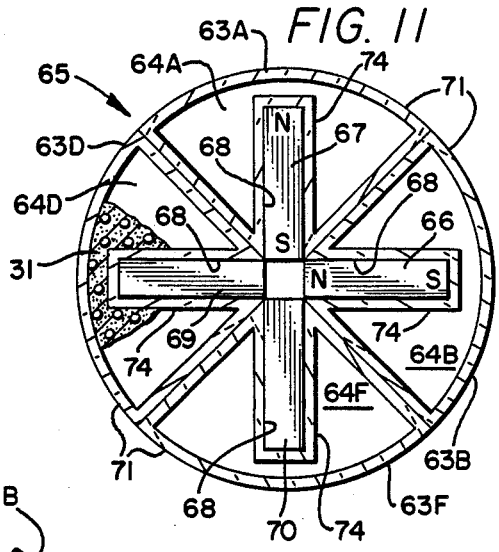
FIG. 11, an enlarged cut-away and sectioned view of the inner spherical display element taken along line 11—11 of FIG. 10.
Figure 12:
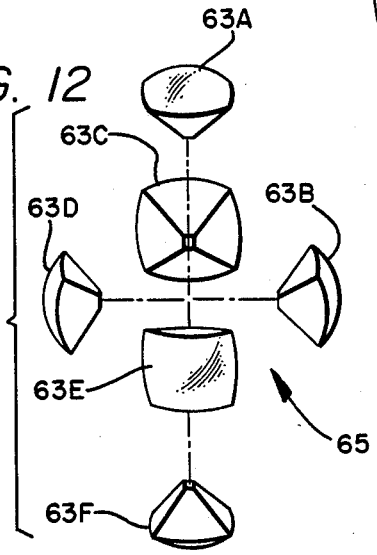
FIG. 12, an exploded perspective view of the six segments of the display element of FIGS. 9-11.

The pixel cylindrical element 20, of FIGS. 1-7, that may be flip rotated from one color position to another is used in multiple quantities running from tens of units up to hundreds of units and even more in multi-element color graphics information display panels 21 as shown in FIG. 8. The cylindrical element 20 is shown in FIGS. 1-4A to be a four cavity 22A, 22B, 22C and 22D four color pixel with a cylindrical sleeve 23 of transparent plastic running approximately one inch in diameter and a little over an inch in length enclosed at opposite ends by plastic end disks 24 that are glued or plastic welded in place. The four cavities 22A-D are formed with two molded sections 25 that together have a center circular boss 26 that encloses a circular permanent magnet 27 with the two sections 25 plastic welded together. Molded sections 25 are each formed with a tubular center section 28 extending outward from boss 26 upon which four plastic walls 29 are formed that have extensions 30 over the radial outer circumferential surface of boss 26 so that when plastic welded (or glued) together in assembly they together form the four cavities 22A-D that are closed when plastic end disks 24 are welded in place. The pixel units 20 are generally assembled leaving one plastic end disk 24 off so that the cavities may be filled with color pigment mixes 31, either liquid or powder, that, particularly if powder include glass beads 32 that in pigment powder or liquid aids in mix stirring the pigment with movement of the pixel and lends a degree of backlight transparency to some pigment glass beads mixes. After the cavities 22A-D are filled with color pigment mix, respectively, of the desired colors the remaining plastic end disk 24 is plastic welded in place closing the pixel cavities. Each plastic end disk 24 is provided with a longitudinally extended mounting boss 33 that extends out for bearing contact with a disk boss 33 of an adjoining pixel 20 as shown in FIG. 7 and has a center opening 34 for rotational mounting of pixels 20 on mounting rods 35. The plastic end disks 24 are also each provided with two registry projections 36 that with respect to one end disk 24 of each pixel 20 extend into openings 37 of a thin square sheet 38 of ferritic material with truncated cut off corners 39 and a center opening 40 that fits mounting boss 33 in the mounting of ferratic material end sheet 38 on one end of each cylindrical pixel 20 such as shown in FIGS. 5, 6 and 7.

Referring additionally to FIGS. 5 and 6 positive indexing and precisely position stopping each cylindrical pixel 20 at a desired one of four colors is via pull from a small permanent magnet 41 attracting a truncated cut-off corner 39 of the ferratic material end sheet 38 in maintaining a collar set position for the respective pixel 20. A small permanent magnet 41 is position mounted in the overall sign graphic display structure for each pixel 20. The pull from the small permanent magnet 41 with each ferratic material end sheet 38 is overcome by the electromagnetic coil 42 or a back positioned electromagnetic coil 43 for respective pixels 20 when one or the other of them is energized. This electromagnetically drives the pixel 20 to a new rotated color position via the electromagnetic action of the coils 42 and/or 43 on the pixel circular permanent magnet 27. This is controlled via such as the computer pixel drive control described in the parent application hereof. The four pixel 20 magnetic operation set positions are controlled by coils 42 and 43, that are round flat thin type coils and the rotable permanent magnet 27 that must always come to rest in a set position with its North-South pole axis horizontal or vertical and in alignment with two opposite cut-off corners 39 of ferratic material end sheet 38 that are attracted by the small permanent magnet 41. As an electric current is passed through a winding of one of the coils 42 or 43, that can be either single winding coils as indicated in FIG. 5 or bifilar two wire wound coils with four terminals as shown in FIG. 6 and a control circuit 44 such as shown schematically other than for its instant static position, the static magnetic attraction of a small permanent magnet 41 is overcome by the stronger pull (or push) of the electromagnet activated and the display pixel rotates to the new position and is again held by the static attraction force of the small permanent magnet 41. If the coils 42 and 43 are single wire wound coils they are provided with current on-off and reverse switching control. The bifilar two wire wound coils 42 and 43 as shown in FIG. 6 control circuit 44 have a DC voltage supply 45 with one side connected in common 46 to a terminal of each winding and with the other terminal of each winding connected through a switch 47 and 48, respectively, to the other side of DC voltage supply 45. It should be noted that each of the coils 42 and 43 is provided with a magnetic circuit shield disk 49 on the back side thereof from the pixel 20 position controlled thereby.

Figure 6A:
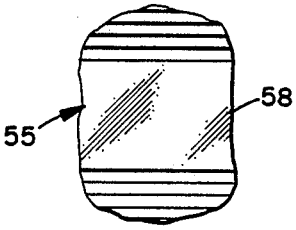
FIG. 6A, a fragmentary view taken from line 6A—6A showing detail of the color field of view enlarger and front cover.

With four (or six) color zones on a cylindrical pixel 20 (or 20′ with six color zones) when a pixel 20 is set to a desired color the field of view of that color is only part of what is exposed i.e. parts of adjacent color zones and, in a multi-element color graphics information display panel 50 such as shown in FIG. 8 using the pixels, electromagnetic coils 42 and mounting structure. This can be covered by color field of view enlarging mirrors 51 indicated in phantom in FIG. 5 that are formed in elongate "V" shaped strips with reflecting faces 52 that extend between sides 53 of each sign subsection 54 that are used to make up a multi-element color graphics information display panel 50. The reflecting faces 52 are so angled as to effectively expand the field of view of pixel colors to the viewer. An alternate color field of view enlarger is shown in FIGS. 6, 6A and 8 wherein a combination Fresnel grooved and transparent cover panel 55 is used one for each horizontal row of pixels with a "V" tongue 56 and groove 57 interconnect between panels 55. Each panel 55 has a center clear view strip 58 generally overlying the color field of view of the pixels 20 therebehind with inwardly facing Fresnel grooving 59 above and below the center clear view strip directing the view of the observer toward the color field of view thereby expanding the color perceived to the width of the panel 55.

Figure 1:
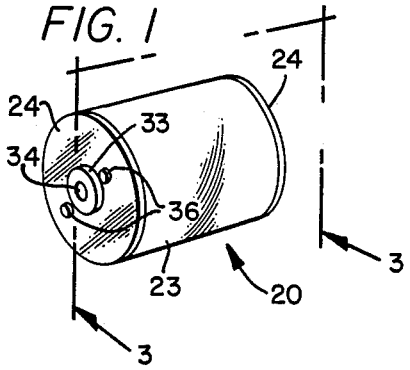
FIG. 1 represents a perspective view of a multi-cavity color graphics information display pixel.
Figure 4A:
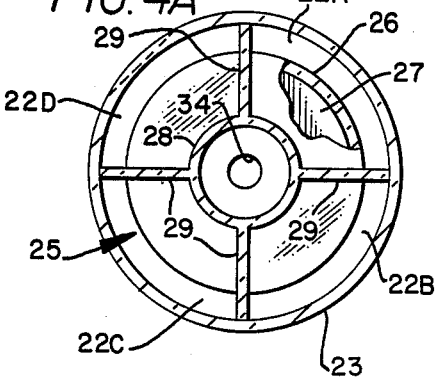
FIG. 4A, a cut-away and sectioned enlarged detail view taken along line 4A—4A of FIG. 3, showing additional detail of a four cavity pixel.
Figure 2:
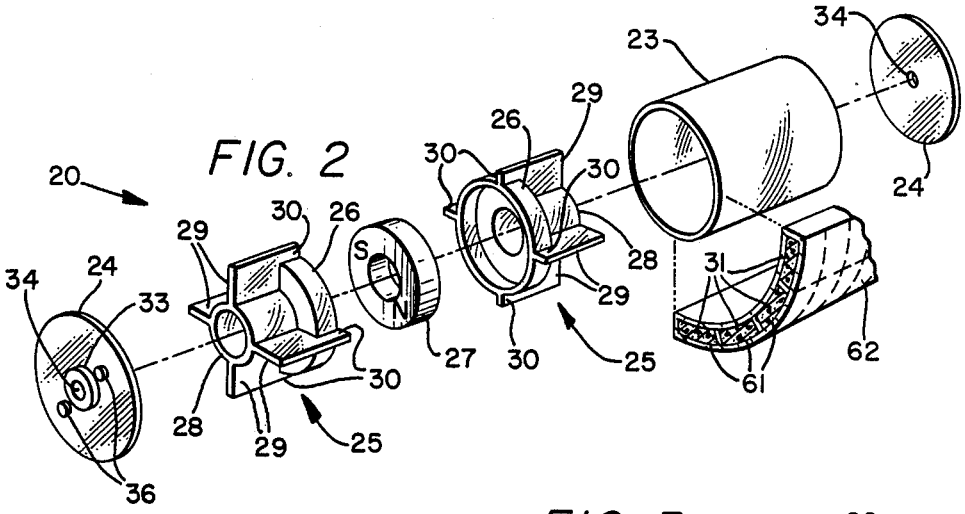
FIG. 2, an exploded perspective view of the multi-cavity pixel of FIG. 1.
Figure 3:
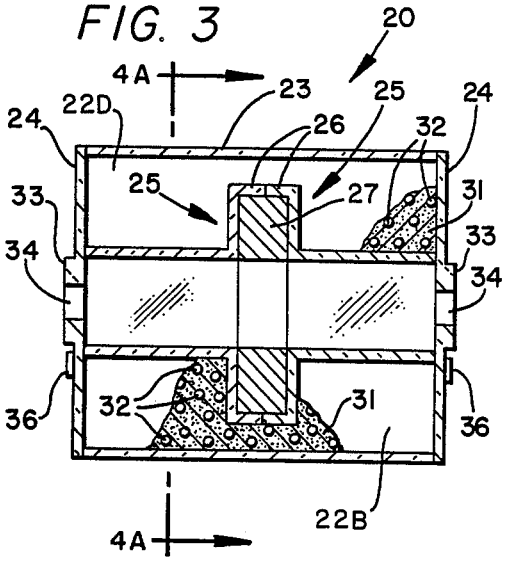
FIG. 3, a cut-away and sectioned enlarged view taken along line 3—3 of the pixel of FIG. 1 showing detail with color pigment and glass bead mixes indicated in place in pixel cavities and with a circular permanent magnet enclosed therein.
Figure 4B:
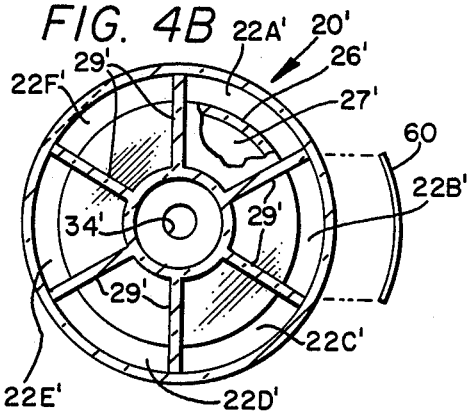
FIG. 4B, a cut-away and sectioned enlarged detail view of a six cavity pixel like the showing of a four cavity pixel of FIG. 4A and with a cavity section overlay.

The six color pixel 20' thay may be used in place of the four color pixel 20 is useable in a color pigment graphics information display with each six color drum pixel using three electromagnetic coils positioned sixty degrees apart (detail not shown). Each six color pixel 20' has six cavities 22A', 22B', 22C', 22D', 22E' and 22F' separated one from the other by six plastic walls 29' with the cavities filled by color pigment mixes desired. It should be noted that with respect to one or more colors that may not be significantly subject to fading in sunlight or ultraviolet radiation such as black, a colore overlay strip 60 may be used that is adhesive backed to cover the outer cylindrical window of a cavity 22. Further, an overlay of multi-pocketed 61 plating (or sheeting) 62 containing color pigment mix 31, as shown in FIG. 2, is useable in place of a straight color overlay strip 60. The plating 62 that is shown in enlarged fragmentary form in FIG. 2 is adhesive backed for mounting in position on a pixel cylinder 23.

In the spherical six segment 63A–F six cavity 64A–F pixel 65 embodiment of FIGS. 9, 10, 11, 12, 13A–F and 14 it should be noted that two permanent bar magnets 66 and 67 are mounted in two adjacent segments of segments 63A–F in openings 68 thereof that extend radially outward from the inner apex of each segment 63A–F with the North Pole N of permanent bar magnet 66 adjacent the South Pole S of magnet 67. Non-magnetic counter weights 69 and 70 may be inserted in segment openings 68 opposite those containing permanent bar magnets 66 and 67 in order that the assembled spherical pixel 65 be more statically balanced than would otherwise be the case. The individual segments 63A–F are identical with each a truncated pyramid terminated at the top by an opening 68 and closed at the bottom by a transparent spherical surface section 71 that when the segments 63A–F are assembled together as by being glued together the outer spherical surface sections 71 together form a sphere. Instead of being glued together the segments 63A–F may be held together within a spherical shell formed by transparent hemospheric shell halves 72 rotatably supported within an outer spherical shell formed with transparent shell halves 73. Each of the individual segments 63A–F is formed with an internal boss 74 containing the segment opening 68 with the boss 74 terminating short of the segment outer spherical surface section in order that color pigment mixes 31, either liquid or powder, filling each cavity 64A–F projects its color through the extent of each, respective, spherical surface section 71. The spherical pixels 65 are arranged in rows and columns ritatably supported much the same as shown in the parent application and controlled in the same manner. Three coils 75, 76 and 77 in "U" configuration are provided for each spherical pixel 65 one over the top (or at the rear) and the other two on opposite sides. These coils 75, 76, and 77 are shown as single wire wound coils that require current reversal in causing controlled movement to the six different settings of the pixel 65. Bifilar coils 75', 76' and 77' may be used such as indicated in FIGS. 13A–F in causing controlled movement to the six different settings of the pixel 65. In any event whether the coils are bifilar coils or single wire coils ferrous metal plate disks 78, 79 and 80 are placed over the outer sides of the electromagnetic coils such as shown with coils 75, 76, and 77 as rear magnetic path media shields and as a magnetic force attraction media for static holding force with the bar magnets 66 and 67 in the six various electromagnetic coil set positions. This holding force prevents set position drift movement of the inner sphere when no current is flowing in any one of the coils 75, 76 or 77.

A Fresnel panel expander panel and front cover 81, shown in FIG. 14, is useable, like panels 55 of FIGS. 6, 6A and 8, over horizontal rows of pixels 65. Each panel and front cover 81 includes clear direct view field of view portions 82 above and below horizontal directed Frensel grooved portions 83, opposite side vertically directed Frensel grooved portions 84, and forty five degree angled Frensel grooved portions 85A–D expanding the set pixel color field of view.

The color pigment mixes 31 that are either a liquid or pigment powder is useful as a fluoroscent pigment mix and other color pigment mix that is fade resistant in graphic presentations where sun or ultraviolet radiation causes deterioration of color pigment. A mix of glass beads may be used with the color pigment mixes. Fiberglass fill may also be used with these color mixes and silica may also be used as a color pigment extender. Controlled percentage mix of glass beads can be useful in backlighting a pigment mix with rear illumination, either visible light or infrared, could enter a color display cylinder pixel at each end and diffuse through the pigment mix to make the color glow. The various color pigment mixtures used tumble in their cavities with rotative movement of the pixel and since there is a much larger quantity of color pigment than in a painted surface or colored tape overlay, the exposure to ultraviolet radiation is less and resultant fading is much slower. Further, with multi-color pixels, each pixel color faces outward a smaller portion of the time with consequent reduced radiation exposure time.

Whereas this invention has been described with respect to several embodiments thereof, it should be realized that various changes may be made without departure from the essential contributions to the art made by the teachings hereof.

I claim:

1. A color graphics information display with a plurality of mutually adjacent display pixel elements comprising: a plurality of display pixels with each pixel having a plurality of cavities for containing color media of respective selective colors; color media material mixtures in different colors inserted in said plurality of cavities in said pixels; mounting means for said display pixels with said display pixels rotatable in said mounting means; permanent magnet means mounted in each of said display pixels; a plurality of electromagnetic coils mounted in said information display in close proximity to each of said display pixels with said coils being inangled relationship one to the other; and a connection means for connecting a current driving control means to each of said coils; and wherein color pigments are used in said color media material mixtures in different colors to fill pixel cavities as fade resistant color media of the respective colors where exposure to sunlight or ultraviolet radiation otherwise tends to cause deterioration of color pigment.

2. The color graphics information display of claim 1, wherein each of said coils is backed by ferrous metal plating providing shielding between adjacent display pixels; and permanent magnet means with the display pixels fixing set positions of said display pixels.

3. The color graphics display of claim 2, wherein each of said coils are round flat thin type coils projecting relatively large areas of flux into the area of respective display pixels when current is passed through said coils.

4. The color graphics display of claim 3, wherein said color media material mixtures include glass particles.

5. The color graphics display of claim 4, wherein said glass particles include glass beads.

6. The color graphics infromation display of claim 3, wherein said color media material mixtures include fiberglass fill.

7. The color graphics information display of claim 3, wherein said color media material mixtures include silica.

8. The color graphics information display of claim 3, wherein said color media material mixtures include color pigment mixes in powder form.

9. The color graphics information display of claim 5, wherein said color media material mixtures are in liquid form.

10. The color graphics information display of claim 3, wherein said display pixels are multi-cavity pixels formed with a transparent cylinder having a plurality of different color pigment enclosing compartment cavities; and with the cylindrical multi-cavity pixels rotatably mounted on a center rod mounting therefor.

11. The color graphics information display of claim 10, wherein said permanent magnet means with the display pixels fixing set positions of said display pixels includes a permanent magnet adjacent a first end of each of said cylindrical multi-cavity pixels; and a thin sheet of ferritic material with multiple edge portions duplicating the number of cavities in the multi-cavity pixel moveable into adjacent proximity to a pole of the permanent magnet adjacent a first end of a pixel for positive indexing of the pixel cylinder at each of it's multi-cavity settings.

12. The color graphics information display of claim 4, wherein said cylindrical multi-cavity pixels are four cavity pixels; and said thin sheet of ferritic material is in the form of a square sheet of ferritic material with truncated corners non-rotatably mounted on the end of each four cavity pixel.

13. The color graphics information display of claim 11, wherein said cylindrical multi-cavity pixels are six cavity pixels; and said thin sheet of ferritic material is in the form of a sheet of ferritic material with six edge portions non-rotatably mounted on the end of each six cavity pixel.

14. The color graphics display of claim 11, wherein colored overlay strips are provided for covering of cavity color field of view with the colored overlay strips in colors not significantly subject to fading in sunlight.

15. The color graphics display of claim 11, wherein an overlay for covering a cavity color field of view is provided with the overlay being a multi-pocketed rectangular sheet with the multi-pockets containing color pigments.

16. The color graphics display of claim 11, wherein said multi-cavity pixel color field of view settings have color field of view enlarging means.

17. The color graphics display of claim 16, wherein said color field of view enlarging means is elongate mirror strip means mounted to enlarge pixel row fields of view.

18. The color graphics display of claim 16, wherein said color field of view enlarging means is a transparent panel including Frensel grooving to expand the color field of view of pixel rows in a display.

19. The color graphics display of claim 3, wherein said display pixels are spherical six color segment six cavity pixels each having two transparent spheres one mounted by mounting means for relative movement within the other sphere; said permanent magnet means is two permanent bar magnets at right angles to each other within the pixel with the North Pole of one adjacent the South Pole of the other permanent magnet; and three electromagnetic coils with each display pixel with each coil at right angles to at least one of the other coils.

* * * * *